United States Patent [19]

Black et al.

[11] Patent Number: 4,887,247

[45] Date of Patent: Dec. 12, 1989

[54] COMPLIANT TUBE BAFFLE

[75] Inventors: Robert H. Black, Jacksonville, Fla.; Samuel J. Caprette, Jr., Chagrin Falls, Ohio

[73] Assignee: The B. F. Goodrich Company, Akron, Ohio

[21] Appl. No.: 214,917

[22] Filed: Jun. 28, 1988

Related U.S. Application Data

[63] Continuation-in-part of Ser. No. 157,008, Feb. 18, 1988, abandoned.

[51] Int. Cl.[4] ..... H04R 17/00

[52] U.S. Cl. ..... 367/151; 367/162; 367/176

[58] Field of Search ..... 367/1, 141, 151, 152, 367/157, 160, 161, 162, 163, 164, 165, 167, 172, 173, 174, 176, 180, 188, 901; 181/402, 175, 198, 206, 207, 208, 264, 271, 279, 280, 282

[56] References Cited

U.S. PATENT DOCUMENTS

| | | | |
|---|---|---|---|
| 2,811,216 | 10/1957 | Harris | 367/176 |
| 3,021,504 | 2/1962 | Toulis | 367/141 |
| 3,500,305 | 3/1970 | Vincent | 367/141 |
| 4,166,229 | 8/1979 | DeReggi et al. | 310/800 |
| 4,184,093 | 1/1988 | Sullivan | 310/331 |
| 4,399,526 | 8/1983 | Evnck | 367/151 |
| 4,431,873 | 2/1984 | Dunn et al. | 367/165 |
| 4,669,573 | 6/1987 | Goodman | 181/286 |
| 4,709,361 | 11/1987 | Dahlstrom et al. | 367/165 |
| 4,759,000 | 7/1988 | Reitz | 367/176 |

OTHER PUBLICATIONS

Water-Borne Sound Insertion Loss of a Planar Compliant-Tube Array by M. C. Junger, J. Acoust, Soc. Am 78 (3) Sep. 1985.

*Primary Examiner*—Brian S. Steinberger

*Attorney, Agent, or Firm*—David M. Ronyak; Frederick K. Lacher

[57] ABSTRACT

A compliant tube baffle for use in a marine environment wherein a boxlike structure (10) is surrounded by an elastomeric cover (64) and includes a pair of beam plates (12,14) separated by suitable means such as bent plate springs (18,20) which may be engageable with elastic cushioning layers (54) adhered to side shields (52). The beam plates (12,14) may be tapered with the tapered sections (34) having curved surfaces in the form of an ellipse. Damping may be provided by piezoelectric elements (58) or by constrained layers (66) of elastomeric material stressed during flexing movement of the beam plates (12,14). The beam plates (72,74) may also be separated at the edges (84) by elongated members (78,80) of solid elastomer or members (92,94) of a laminate of elastomer and rigid material.

16 Claims, 3 Drawing Sheets

FIG. 5
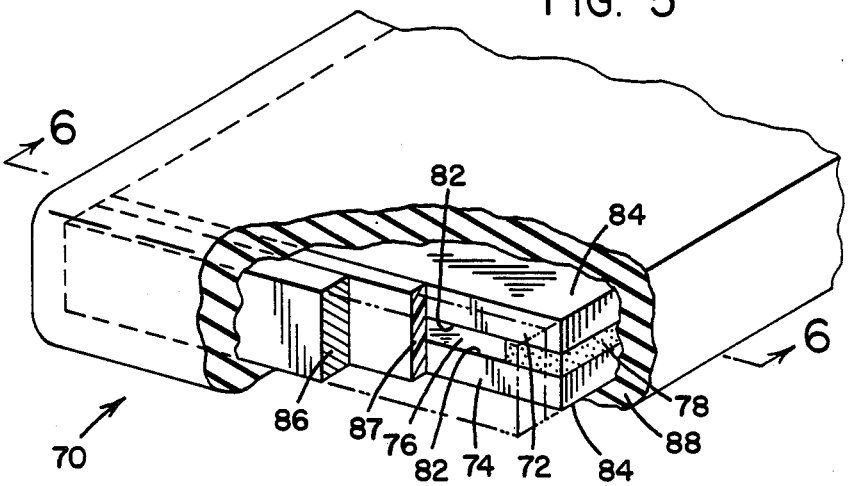
FIG. 6
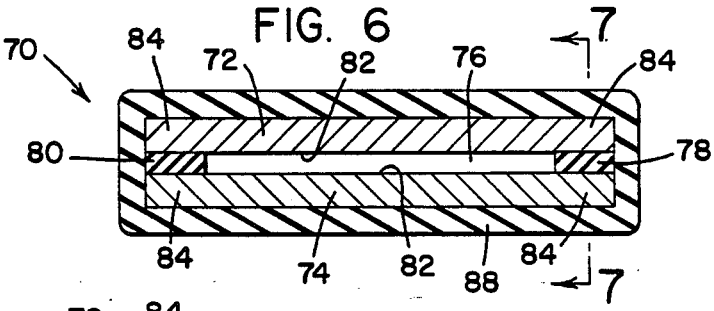
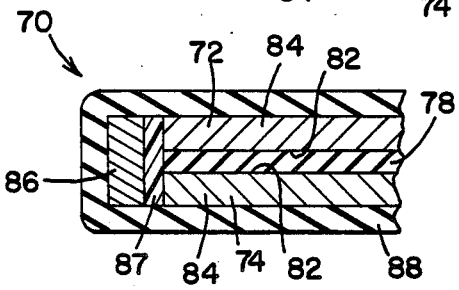
FIG. 7
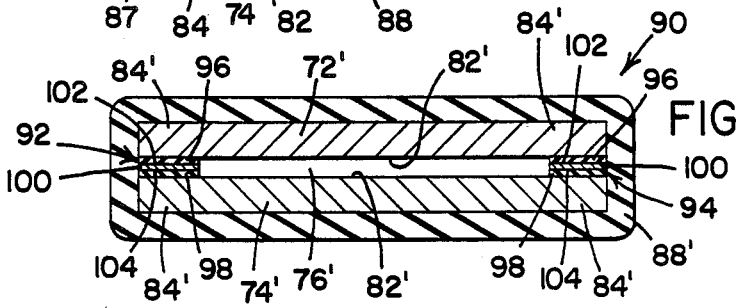
FIG. 8

COMPLIANT TUBE BAFFLE

FIELD OF THE INVENTION

This invention is a continuation-in-part of copending U.S. application Ser. No. 157,008 filed Feb. 18, 1988, now abandoned, and relates to sonic reflectors and absorbers or barriers configured for use in a marine environment, or particularly to sonic reflectors and absorbers configured for operation in a deep water environment where it is also desirable to dissipate energy to reduce reflections off of the sonic reflectors.

BACKGROUND OF THE INVENTION

Sonic reflectors configured for deep water marine environments are subject to elevated hydrostatic pressures and as a result have been subject to operational difficulties, particularly where it is desired that low frequencies be reflected. A high pressure baffle configuration finding acceptance in deep water environments is the so-called squashed tube baffle shown and described, for example, in U.S. Pat. No. 3,021,504 (Toulis). A second type of high pressure baffle configuration is the compliant tube baffle shown and described in copending patent application Ser. No. 051,799 filed May 20, 1987 and assigned to the assignee of this application. The compliant tube construction consists of a boxlike structure possessed of a length substantially in excess of the width or thickness thereof. Each of these compliant tube structures have longitudinal elements such as a pair of plates disposed in a generally parallel plane relationship. The compliant tubes are covered with plies of an elastomeric encapsulant with an elastomer imparting to the elastomeric encapsulant plies the desired acoustic properties. The plates of the compliant tube are supported at the sides and are deflected in deep water but will maintain a space within the boxlike structure to reflect sonic frequencies emanating from the vessel on which the tube is mounted. However, means are needed for dissipating energy to reduce reflections off the sonic reflector and to provide for a wider frequency spectrum.

SUMMARY OF THE INVENTION

The present invention provides a hollow boxlike structure for a sonic reflector that maximizes the acoustic performance of the parallel spaced beam elements by tapering the beam elements to provide maximum dynamic displacement. An additional resonant mode may be provided by positioning a spring element between the beam elements. Further dissipation of energy may be provided by a side elastic element bonded to the spring element for shear stress upon deflection of the spring element.

A piezoelectric damping element provides the acoustic absorption of the elastic beam elements. Alternatively, a constrained layer of elastomeric material may be positioned between a high modulus plate element and one of the beam elements to provide the desired damping.

In another modification the beam elements may be separated at the edges by elongated spacer members of solid elastomer or a laminate of elastomer and rigid material.

In accordance with one aspect of the invention there is provided a boxlike structure suitable for use in a sonic reflector, configured for submersion into deep waters of a marine environment comprising a pair of generally rectangular, tapered elastic beam elements positioned in generally parallel planes and spaced-apart separating means positioned between the beam elements and in engagement with side edges of the beam elements to separate the beam elements, each of the beam elements having a length measured between ends of the beam elements substantially in excess of a width measured between sides of the beam elements, each of the beam elements having a thickness at a center portion greater than a thickness at side portions to provide maximum dynamic displacement with minimum unit stress and an elastomeric encapsulant surrounding and encapsulating the boxlike structure and formed principally of an elastomer for preventing water penetration while providing the desired acoustic properties.

In accordance with another aspect of the invention there is provided a damper for a sonic reflector including an elastic beam element of a boxlike structure, a piezoelectric element attached to the beam element, a cover plate attached to the piezoelectric element and an electronic circuit between the beam element and the cover plate responsive to compression of the piezoelectric element due to deflection of the beam element for dissipating energy to reduce reflections off the sonic reflector and to provide a wider frequency spectrum.

In accordance with still another aspect of the invention there is provided a damper for a sonic reflector including an elastic beam element of a boxlike structure, a constrained layer of elastomeric material attached to the elastic beam element and a high modulus plate element attached to the constrained layer for causing high shear stresses in the constrained layer upon flexing of the beam element to dissipate the energy of the beam element motion by the hysteresis of the elastomeric material of the constrained layer.

In accordance with a further aspect of the invention there is provided a boxlike structure suitable for use in a sonic reflector, configured for submersion into deep waters of a marine environment comprising a pair of generally rectangular elastic beam elements positioned in generally parallel planes and spaced-apart separating means positioned between the beam elements and in engagement with side edges of the beam elements to separate the beam elements, each of the beam elements having a length measured between ends of the beam elements substantially in excess of a width measured between sides of the beam elements, each of the beam separating means including spring means between the beam elements and an elastomeric encapsulant surrounding and encapsulating the boxlike structure and being formed principally of an elastomer for preventing water penetration while providing the desired acoustic properties.

The above and other features and advantages of the invention will become more apparent when considered in light of a description of a preferred embodiment of the invention together with drawings showing other embodiments of the invention and which form a part of the specification.

DESCRIPTION OF THE DRAWINGS

FIG. 5 is a fragmentary perspective view of a modified compliant tube baffle of the invention with parts broken away to show the elements of the invention.

FIG. 6 is a cross-sectional view of the baffle of FIG. 5 taken along line 6—6 in FIG. 5.

FIG. 7 is a fragmentary sectional end view of the baffle of FIG. 5 taken along the line 7—7 in FIG. 5.

FIG. 8 is a cross-sectional view like FIG. 6 of a further modification of the invention.

BEST EMBODIMENTS OF THE INVENTION

Figure 1:
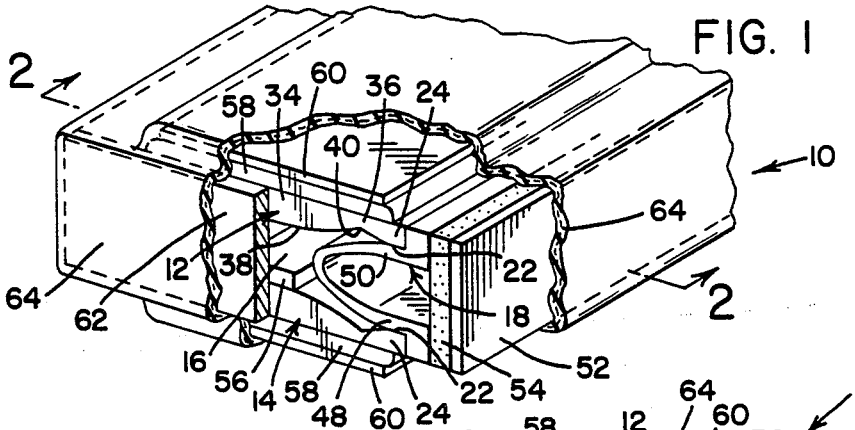
FIG. 1 is a fragmentary perspective view of a compliant tube baffle made in accordance with this invention with parts being broken away to show the elements of the invention.
Figure 2:
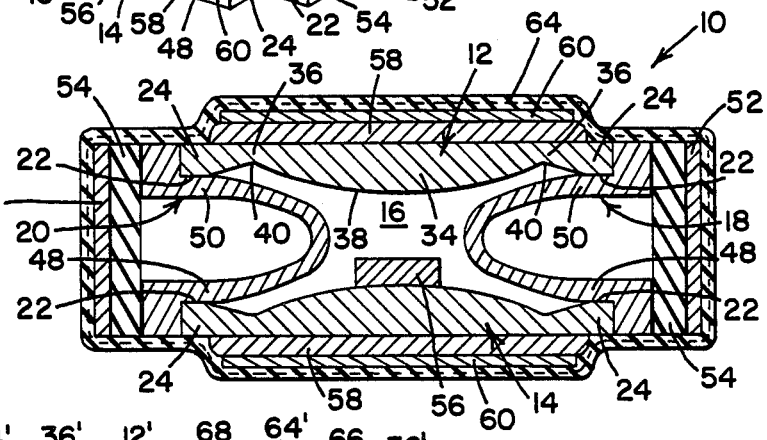
FIG. 2 is a sectional view of the baffle of FIG. 1 taken along line 2—2 of FIG. 1.

Referring to FIGS. 1 and 2, a boxlike structure 10 suitable for use in sonic reflector configured for submersion into deep waters of a marine environment is shown. The boxlike structure 10 has a pair of generally rectangular, tapered elastic beam elements such as upper beam plate 12 and lower beam plate 14 positioned in generally parallel planes and spaced apart to provide an air cavity 16 within the structure. Separating means such as bent beam springs 18 and 20 are positioned between the beam plates 12 and 14 and engage bearing surfaces 22 at side edges 24 of the beam plates. Preferably each of the beam plates 12 and 14 have a length measured between the ends of the beam plates substantially in excess of a width 26 of the beam plates.

A further description of the upper beam plate 12 designed for 1300 hertz is also applicable to the description of the lower beam plate 14. The thickness 28 of the beam plate 12 at the center portion is greater than the thickness 30 at the side portions to provide maximum dynamic displacement with minimum unit stress. In the embodiment shown, the beam plate 12 is of steel and the thickness 28 at the center portion is 0.28 inches (0.71 centimeters) and the thickness 30 at the side portions is 0.15 inch (0.38 centimeters). The width 26 of the beam plate 12 between the bearing surfaces 22 is 4.0 inches (10.16 centimeters) and the thickness 32 at the bearing surfaces 22 is 0.18 inches (0.46 centimeters). This thickness 32 is determined by the bearing and alignment constraint during manufacture and assembly. The beam plate 12 has a tapered section 34 between the side portions and reduced thickness portions 36 where the thickness 30 at the side portion is located. The tapered section 34 has a curved surface 38 preferably in the form of an ellipse. A curved connecting surface 40 is provided between the curved surface 38 of the tapered section 34 and the bearing surface 22 to mitigate stress concentrations of the reduced thickness portions 36. In the preferred embodiment, radius 42 of the curved connecting surface 40 is 0.055 inches (0.14 centimeters). The reduced thickness portions 36 are located at positions spaced from the bearing surfaces 22 and in the embodiment shown, this spaced distance 44 is 0.35 inches (0.89 centimeters). Also, the width 46 of the bearing surfaces 22 is 0.15 inches (0.38 centimeters). At the center portion of the beam plate 12, the moment is the limiting factor and at the reduced thickness portions 36 the shear stresses are the limiting factor. For optimal acoustic properties and resistance to the compressive stress in deep waters, the beam plate 12 should have the maximum dynamic displacement for the minimum unit stress.

The bent beam springs 18 and 20 each have a generally U-shaped cross section and have edge portions 48 and 50 in engagement with the bearing surfaces 22. This provides an additional resonant mode for the boxlike structure 10 when used in a sonic reflector.

As shown in FIGS. 1 and 2, side shields 52, which may be of steel, are positioned adjacent each of the edge portions 48 and 50 of the bent beam springs 18 and 20. Interposed between the side shields 52 and the edge portions 48 and 50 of the springs 18 and 20 is an elastic element such as cushioning layer 54 of rubber or other elastomeric material which is adhered to the side shields and edge portions of the springs 18 and 20 as by bonding. The elastomeric material of the cushioning layers 54 resists flexing movement of the bent beam springs 18 and 20 in shear further supplementing the spring action of the springs. A spacer member such as spacing plate 56 may be attached to the lower beam plate 14 to limit the flexing movement of the beam plates especially at great depths to retain the air cavity 16 within the boxlike structure 10 and prevent yielding of the structure.

Damping of the beam plate movement may be provided by mounting piezoelectric elements 58 on the outer surfaces of the beam plates 12 and 14. Cover plates 60 are attached to the outer surfaces of the piezoelectric elements 58. When the yieldable beam plates 12 and 14 bend inward, the piezoelectric elements 58 are compressed and an electrical output perpendicular to the span of the beam plates is produced. In this embodiment, the beam plates 12 and 14 and the cover plates 60 are electrodes and the terminals are placed to provide the desired electrical output in a manner well known to those skilled in the art.

With an active damping system, the electronic circuit is such that output from the piezoelectric elements 58 is used to sense acoustic pressure and provides an out-of-phase active signal to the element to cancel the energy that would otherwise be reflected from the surface of the element. As the piezoelectric elements 58 are compressed, current flows from the elements increasing the voltage which causes the elements to cancel the energy that would otherwise be reflected from the surface of the element.

In the passive damping system using the piezoelectric elements 58 the electronic circuit is such that it includes a resistance which matches the impedance of the piezoelectric elements and maximizes energy dissipation.

End plates 62 are positioned over the air cavity 16 at the ends of the boxlike structure 10 and an elastomeric encapsulant such as cover 64 is wrapped around the boxlike structure and contains reinforcing plies embedded in an elastomer for imparting to the plies the desired strength properties. The end plates 62 and side shields 52 prevent the pressure of the external environment from extruding the cushioning layer 54 into the bent beam springs 18 and 20 and prevent the water from entering the air cavity 16 within the structure 10.

Figure 3:
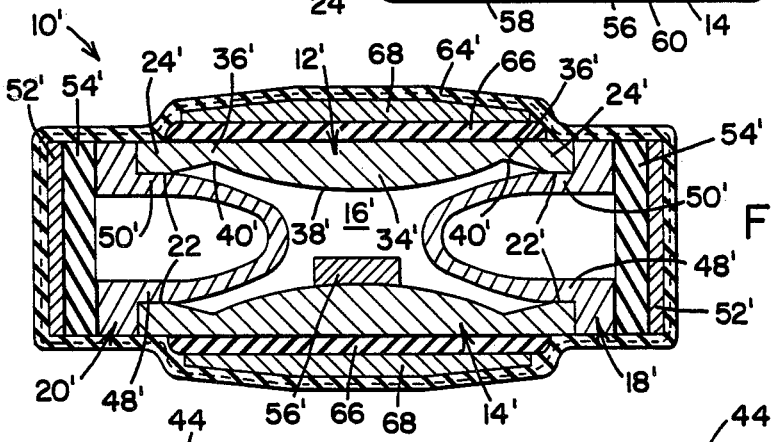
FIG. 3 is a sectional view like FIG. 2 of a modification embodying the invention.
Figure 4:
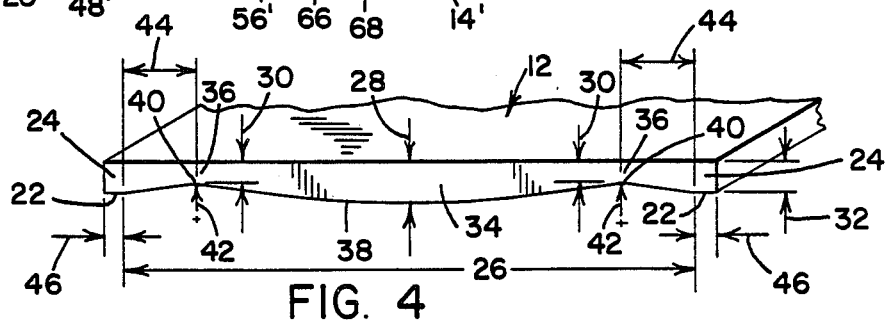
FIG. 4 is an enlarged fragmentary perspective view of one of the beam elements shown in FIGS. 1, 2 and 3.

An optional constrained layer damper system is shown in FIG. 3, wherein the parts which are identical with the parts of the boxlike structure 10 are shown in FIGS. 1, 2 and 4, are identified with the same numeral and a prime mark. In this embodiment, constrained layers 66 of elastomeric material are adhered to the outer surfaces of the beam plates 12′ and 14′. Cover plates 68 are of a high modulus material such as steel and the cover 64′ extends over the cover plates and the rest of the boxlike structure 10'. In operation, the elastomeric material of the damping layers 66 are subject to high shear stress upon flexing of the beam plates 12' and 14' whereby the energy resulting from the motion of the beam plates is dissipated by the hysteresis of the elastomeric material.

Referring to FIGS. 5, 6 and 7, another compliant tube baffle construction embodying the invention is shown. A boxlike structure 70 has a pair of generally rectangular elastic beam elements such as upper beam plate 72 and lower beam plate 74 positioned in generally parallel planes and spaced apart to provide an air cavity 76 within the structure. Separating means such as elongated separating members 78 and 80 are positioned between the beam plates 72 and 74 and engage surfaces 82 at the side edges 84 of the beam plates.

In the embodiment shown, the separating members 78 and 80 are of an elastomeric material such as rubber and are adhered to the surfaces 82 of the beam plates 72 and 74 as by hot or cold bonding. The type of bonding depends upon the bond strength required for a given application.

End plates 86 may be positioned at the ends of the boxlike structure 70 and a cover 88 wrapped around the boxlike structure to prevent water from entering the air cavity 76 within the structure. End inserts 87 of a non-metallic material may be interposed between the end plates 86 and the beam plates 72 and 74. The end plates 86 and beam plates 72 and 74 may be of a high strength elastic material such as steel.

In the embodiment shown in FIGS. 5, 6 and 7, which is designed for a resonant frequency of around 1.5 kHz, the beam plates 72 and 74 and the end plates 86 may be standard specification steel plates and no fabric reinforcement is required for the cover 88. A typical boxlike structure 70 has a width of 3.8 inches (9.65 cm), a length of 24 inches (60.96 cm) and an overall thickness of 1 inch (2.54 cm). The beam plates 72 and 74 have a thickness of 0.24 inches (0.61 cm) and are of a steel such as SAE 4340. The separating members 78 and 80 are of an elastomer such as natural rubber having a Shore A durometer hardness of 60. The separating members 78 and 80 typically have a thickness of 0.125 inches (0.32 cm) and a width of 0.4 inches (1.02 cm). With this construction, it has been found that the boxlike structure 70 has low radiated noise because there is no metal-to-metal contact between the beam plates 72 and 74. The manufacturing cost is low because the structure is inexpensive and simple to fabricate. Also for design frequencies such as 1.5 kHz and above and normal operating pressures, the required separation is sufficiently small that no reinforcing fabric is necessary within the cover 88. The beam plates 72 and 74 have uniform plate thickness and therefore off-the-shelf materials with minimal machining can be used.

Referring to FIG. 8, another modification embodying the invention is shown in which a boxlike structure 90 is identical with the boxlike structure 70 shown in FIGS. 5, 6 and 7 except for separating members 92 and 94. The parts which are the same as the parts of the structure 70, shown in FIGS. 5, 6 and 7, are identified with the same numeral plus a prime mark. The separating members 92 and 94 are of a solid elastomer such as natural rubber and are divided into upper portions 96 and lower portions 98 by dividing plates 100 which may be of steel or other high modulus material. By varying the thickness of the dividing plates 100 and the upper and lower portions 96 and 98 the effective spring rate of the separating members 92 and 94 may be modified to meet plate 86'' insulated from the beam plates and the separating members 92'' and 94'' by end inserts 87''. The separating members 92'' and 94'' are laminated and the upper and lower portions 96'' and 98'' adhered to the surfaces 82'' of the beam plates 72'' and 74'' and the surfaces 102'' and 104'' of the dividing plates 100''.

Figure 9:
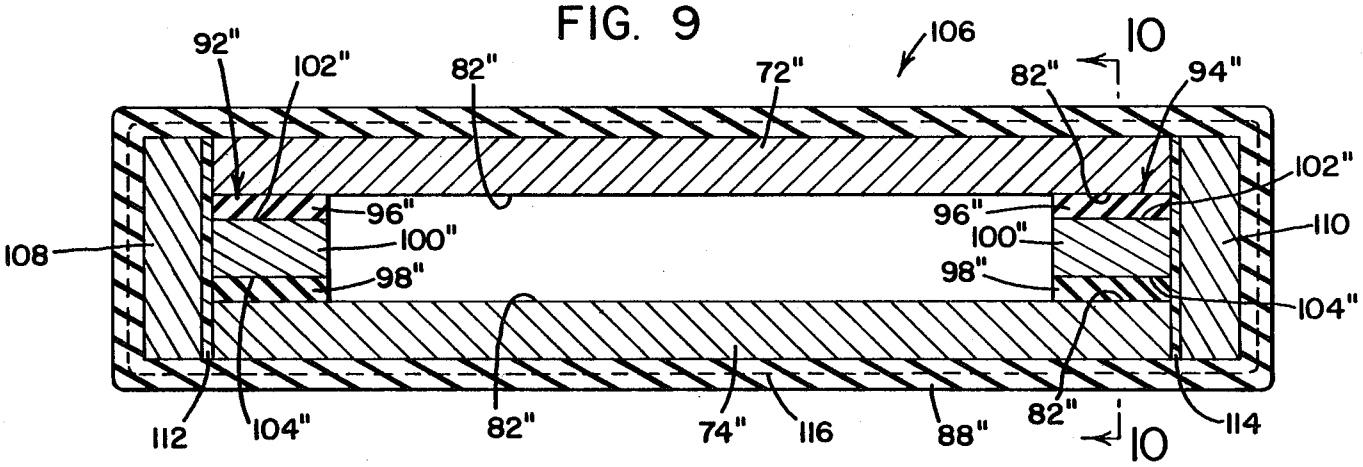
FIG. 9 is a cross-sectional view like FIGS. 6 and 8 showing a still further modification of the invention.
Figure 10:
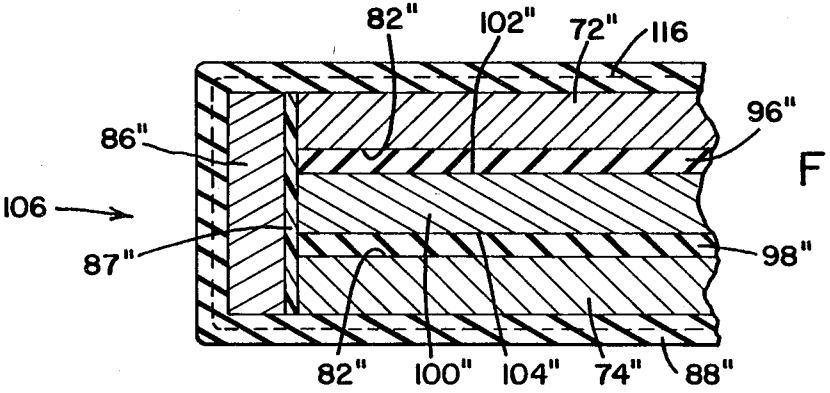
FIG. 10 is a fragmentary sectional end view like FIG. 7 taken along line 10—10 in FIG. 9.

The boxlike structure 106 shown in FIGS. 9 and 10 may typically have a length of 36 inches (91.4 cm) and a width of 8 inches (20.3 cm) with a thickness of 2 inches (5.1 cm). The beam plates 72'' and 74'' may have a thickness of 0.4 inches (1.02 cm) and be of a high modulus material such as steel. The distance between the beam plates 72'' and 74'' may be 0.75 inches (1.9 cm) and the thickness of the dividing plates 100 may be 0.4 inches (1.02 cm). The side shields 108 and 110 may be of steel and have a thickness of 0.125 inches (0.32 cm). The side inserts 112 and 114 may have a thickness of 0.03 inches (0.076 cm) and be of a polymeric material such as Teflon. The cover 88'' may be reinforced with a reinforcing fabric 116 of suitable material such as nylon, rayon or aramid.

While several preferred embodiments and modifications of the invention have been shown for the purpose of illustrating the invention, it will be apparent to those skilled in the art that various changes and modifications may be made therein without departing from the spirit or scope of the invention.

We claim:

1. A boxlike structure for use in a sonic reflector, configured for submersion into a marine environment comprising a pair of generally rectangular tapered elastic beam elements positioned in generally parallel planes and spaced-apart spring means positioned between said beam elements and in engagement with side edges of said beam elements to resiliently separate said beam elements, each of said beam elements having a length measured between ends of said beam elements substantially in excess of a width measured between sides of said beam elements, each of said beam elements having a thickness at a center portion greater than a thickness at side portions with tapered sections between said center portion and said side portions to provide maximum dynamic displacement with minimum unit stress and an elastomeric encapsulant surrounding and encapsulating the boxlike structure and formed of an elastomer for preventing water penetration.

2. The boxlike structure of claim 1 wherein at least one of said tapered sections has a curved surface in the form of an ellipse.

3. The boxlike structure of claim 1 wherein said side portions have bearing surfaces adjacent said side edges of said beam elements for engaging said spring means and said beam elements having a reduced thickness portion between said tapered sections of said beam element and said bearing surfaces, and said reduced thickness portions having a curved connecting surface between said bearing surface and said tapered sections to mitigate stress concentrations at said reduced thickness portions.

4. The boxlike structure of claim 3 wherein said spring means comprises a bent plate spring having a generally U-shaped cross section positioned at each side of said beam elements with edge portions of said bent plate spring engaging said bearing surfaces of said side portions of said beam elements to provide an additional resonant mode.

5. The boxlike structure of claim 4 further comprising a side shield adjacent each said bent plate spring for preventing movement of said elastomeric encapsulant into the space between opposing faces of each said bent plate spring.

6. The boxlike structure of claim 5 further comprising an elastic element positioned between said side shield and said edge portions of each said bent plate spring, said elastic element being adhered to said side shield and to said edge portions of each said bent plate spring whereby flexing movement of each said bent plate spring is resiliently resisted by shear stress of the material of said elastic element.

7. The boxlike structure of claim 1 including a spacer member positioned between said beam elements at a central portion between said side edges for limiting the flexing movement of said beam elements.

8. The boxlike structure of claim 1 including a damper comprising a piezoelectric element attached to each of said beam elements, and a cover plate attached to each said piezoelectric element.

9. The boxlike structure of claim 8 wherein said side portions of said beam elements have bearing surfaces adjacent said side edges for engaging said spring means, each of said beam elements having a reduced thickness portion between a tapered section and each of said bearing surfaces, and said reduced thickness portion having a curved connecting surface between each of said bearing surfaces and said tapered section to mitigate stress concentration at said reduced thickness portion.

10. The boxlike structure of claim 9 wherein said spring means comprises a bent plate spring having a generally U-shaped cross section positioned at each side of each of said beam elements with edge portions of each said bent plate spring engaging said bearing surfaces of said side portions of said beam elements to provide an additional resonant mode.

11. The boxlike structure of claim 10 further comprising a side shield adjacent each said bent plate spring for preventing movement of said elastomeric encapsulant into the space between opposing faces of each said bent plate spring.

12. The boxlike structure of claim 11 further comprising an elastic element positioned between said side shield and said edge portions of each said bent plate spring, said elastic element being adhered to said side shield and to said edge portions of each said bent plate spring whereby flexing movement of each said bent plate spring is resiliently resisted by shear stress of the material of said elastic element.

13. The boxlike structure of claim 1 including a damper comprising a constrained layer of elastomeric material attached to at least one of said elastic beam elements and a high modulus plate element attached to said constrained layer for causing high shear stress in said constrained layer upon flexing of said one of said elastic beam elements to dissipate the energy of the beam element motion by the hysteresis of the elastomeric material of said constrained layer.

14. The boxlike structure of claim 13 wherein said side portions have bearing surfaces adjacent said edges of said beam elements, said spring means comprising, a bent plate spring having a generally U-shaped cross section positioned at each side of said beam elements with edge portions of each said bent plate spring in engagement with said bearing surfaces at said side portions of said beam elements to provide an additional resonant mode.

15. A damper for a sonic reflector including an elastic beam element of a hollow boxlike structure wherein said beam element has a length measured between ends of said beam element substantially in excess of a width measured between sides of said beam element, and said beam element has a thickness at a center portion greater than a thickness at side portions to provide maximum dynamic displacement with minimum unit stress, a piezoelectric element attached to said beam element, and a cover plate attached to said piezoelectric element.

16. A damper for a sonic reflector including an elastic beam element of a hollow boxlike structure wherein said beam element has a length measured between ends of said beam element, and said beam element has a thickness at a center portion greater than a thickness at side portions with tapered sections between said center portion and said side portions to provide maximum dynamic displacement with minimum unit stress, a constrained layer of elastomeric material attached to said elastic beam element and a high, modulus plate element attached to said constrained layer for causing high shear stresses in said constrained layer upon flexing of said beam element to dissipate the energy of the beam element motion by the elastomeric material of said constrained layer.

* * * * *